US011096505B2

(12) United States Patent
Urena

(10) Patent No.: US 11,096,505 B2
(45) Date of Patent: Aug. 24, 2021

(54) ROTATING COLLECTIBLE DISPLAY

(71) Applicant: Edwin Urena, Lakewood Ranch, FL (US)

(72) Inventor: Edwin Urena, Lakewood Ranch, FL (US)

( * ) Notice: Subject to any disclaimer, the term of this patent is extended or adjusted under 35 U.S.C. 154(b) by 0 days.

(21) Appl. No.: 16/057,569

(22) Filed: Aug. 7, 2018

(65) Prior Publication Data

US 2021/0169238 A1 Jun. 10, 2021

(51) Int. Cl.

| | |
|---|---|
| ***A47F 5/02*** | (2006.01) |
| ***A47F 7/14*** | (2006.01) |
| ***A47G 1/12*** | (2006.01) |

(52) U.S. Cl.

CPC ..... *A47F 5/02* (2013.01); *A47F 7/14* (2013.01); *A47G 1/12* (2013.01)

(58) Field of Classification Search

CPC ..... A47F 5/02; A47F 7/14; A47G 1/12; G09F 11/10

See application file for complete search history.

(56) References Cited

U.S. PATENT DOCUMENTS 943,821 A * 12/1909 Feldmann, Jr. .... A47G 25/0685 211/169
1,044,381 A * 11/1912 Harr ..... A47F 7/163 211/169
3,517,827 A * 6/1970 Crosslen ..... A47F 5/02 211/163
3,583,568 A * 6/1971 Crosslen ..... A47F 1/04 211/163
3,960,273 A * 6/1976 Weston ..... A47F 7/0246 211/4
3,997,050 A * 12/1976 Patterson ..... A45C 11/16 206/566
4,258,962 A * 3/1981 Slaugh ..... B25H 3/00 280/79.2
4,632,474 A * 12/1986 Ingersoll ..... A47F 7/02 312/125
5,551,577 A * 9/1996 Hagopian ..... E05B 73/00 211/4
5,782,366 A * 7/1998 Garza, Jr. ..... A47F 7/146 211/169
6,394,291 B2 * 5/2002 Maier-Hunke ..... G09F 15/0087 211/169
7,891,506 B2 * 2/2011 Kornowski ..... A45C 11/16 211/163

* cited by examiner

*Primary Examiner* — Ko H Chan
(74) *Attorney, Agent, or Firm* — John Rizvi; John Rizvi, P.A.—The Patent Professor

(57) ABSTRACT

A rotating display for collectibles such as, without limitation, comic books, magazines, coins, stamps, trading cards, and paper currency. In an embodiment, such a rotating collectibles display enables a collector to display a large number of their collectibles in protective frames, such that the display can rotate to allow the viewing of individual frames, and the frames within the display can rotate to allow the viewing of the back and front of the collectibles within the frames.

20 Claims, 5 Drawing Sheets

ROTATING COLLECTIBLE DISPLAY

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

FIELD

At least some embodiments disclosed herein relate, in general, to display stands, and more specifically display stands for displaying a large collection of collectible items.

SUMMARY

In an embodiment, the present disclosure relates to a rotating display for collectibles such as, without limitation, comic books, magazines, coins, stamps, trading cards, and paper currency. In an embodiment, such a rotating collectibles display enables a collector to display a large number of their collectibles in protective frames, such that the display can rotate to allow the viewing of individual frames, and the frames within the display can rotate to allow the viewing of the back and front of the collectibles within the frames.

BRIEF DESCRIPTION OF THE DRAWINGS

The embodiments are illustrated by way of example and not limitation in the figures of the accompanying drawings in which like references indicate similar elements.

DETAILED DESCRIPTION

The following description and drawings are illustrative and are not to be construed as limiting. Numerous specific details are described to provide a thorough understanding. However, in certain instances, well known or conventional details are not described in order to avoid obscuring the description. References to one or an embodiment in the present disclosure are not necessarily references to the same embodiment; and, such references mean at least one.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

In an embodiment, the present disclosure relates to a rotating display for collectibles such as, without limitation, comic books, magazines, coins, stamps, trading cards, and paper currency. In an embodiment, such a rotating collectibles display enables a collector to display a large number of their collectibles in protective frames, such that the display can rotate to allow the viewing of individual frames, and the frames within the display can rotate to allow the viewing of the back and front of the collectibles within the frames.

Figure 1:
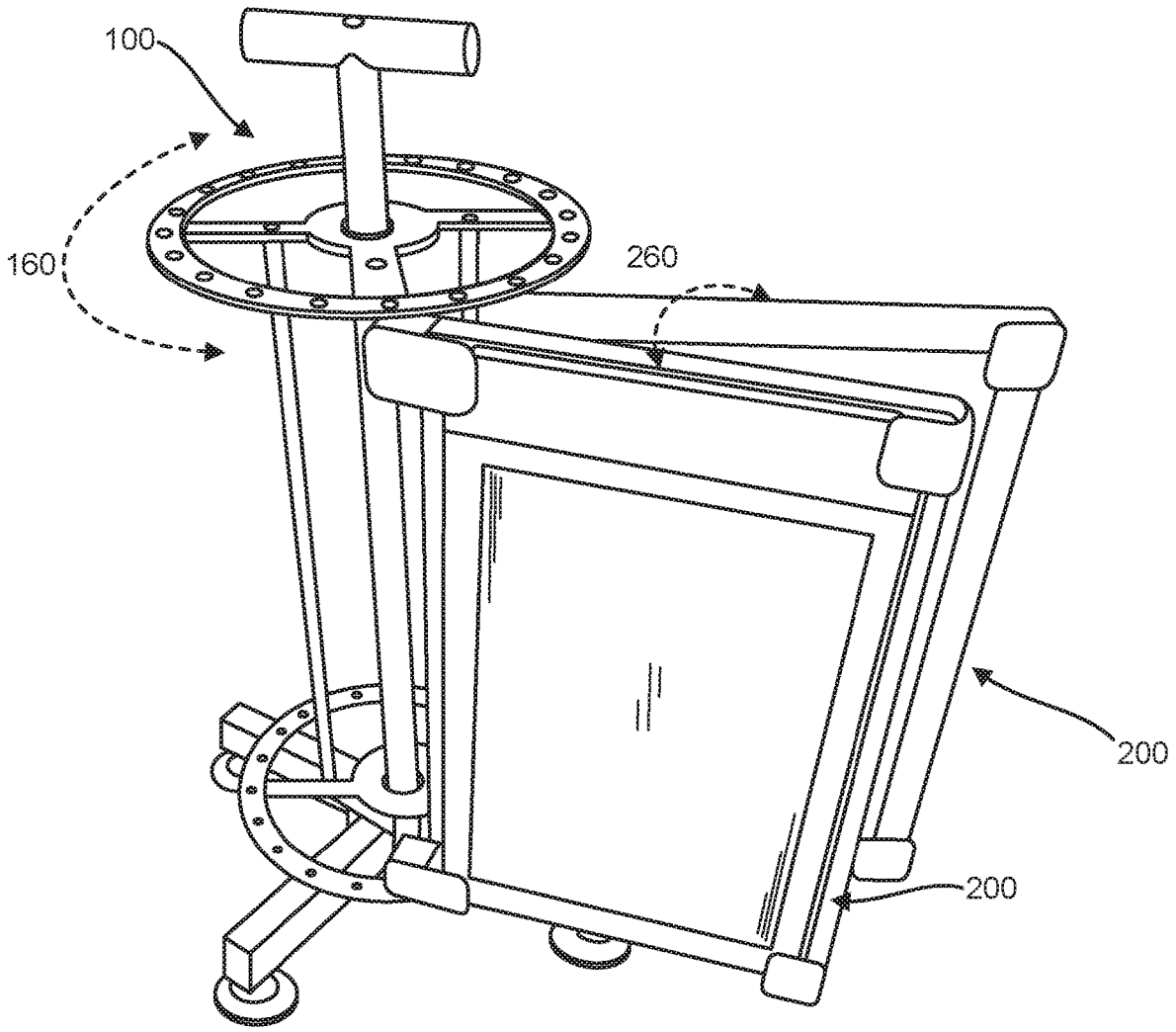
FIG. 1 shows an illustrative embodiment of a rotating collectibles display in accordance with the present disclosure.

FIG. 1 shows an illustrative embodiment of a rotating collectibles display, 100 and 200, in accordance with the present disclosure.

The rotating collectibles display 100 is configured to hold a plurality of item frames 200. The item frame holder of the collectibles display 100 can freely rotate 160 about the stand of the collectibles display. Individual item frames 200 can rotate 260 about hinge points on the item frame holder of the collectibles display 100.

Figure 2:
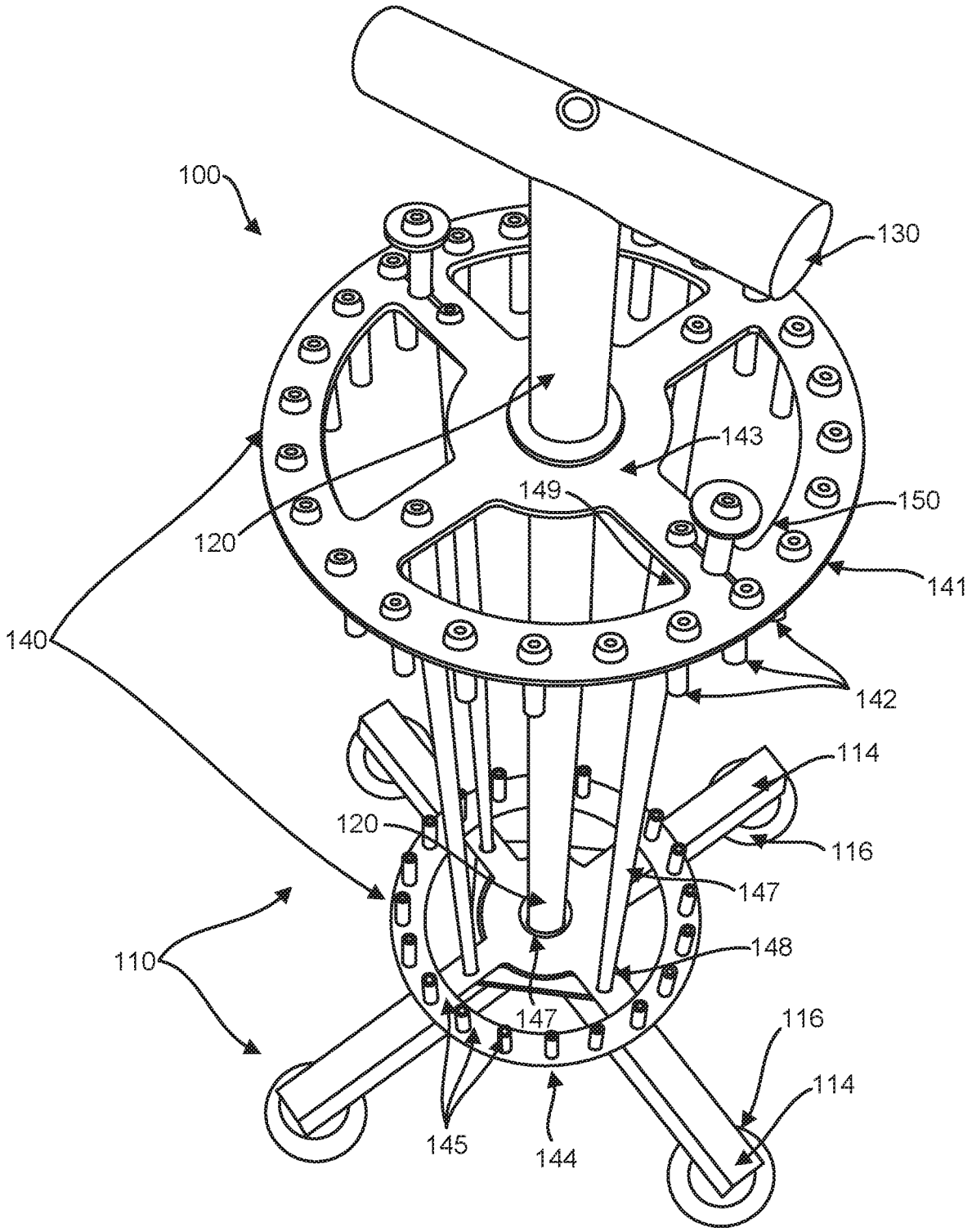
FIG. 2 shows the stand and frame holder of the rotating collectibles display of the rotating collectibles display of FIG. 1 in greater detail.

FIG. 2 shows the stand 110-130 and frame holder 140-150 of the rotating collectibles display 100 of FIG. 1 in greater detail.

In an embodiment, the stand comprises a stand base 110, a stand post 120, and a stand handle 130. In an embodiment, the stand base 110 comprises a plurality of stand legs 114 joined at a single point in the stand base 110. In an embodiment, each of the stand legs 114 has a rubber padded foot 116 at one end of the respective stand leg 114.

In an embodiment, the stand post 120 mounted to the stand base 110 at its center at a 90° angle to the stand base. In various embodiments, the stand post 120 could be mounted to the stand base 110 using a bolt or screw, or alternatively, could be welded to the stand base, or molded into the stand base, where the stand post and the stand base are molded into a single component.

In an embodiment, the stand handle 130 is mounted on the top of the stand post at a 90° angle to the stand post 120, and parallel to the stand base 110. In various embodiments, the stand post 120 could be mounted to the stand post 120 using a bolt or screw, or alternatively, could be welded to the stand post, or molded into the stand post, where the stand post and the stand handle are molded into a single component.

The stand handle 130 is optional, and can be removed without affecting the operation of the display 100. In various other embodiments, the rotating collectibles display stand does not have a handle. In various other embodiments, the stand handle 130 could be mounted to the stand post 120 at an angle other than 90°.

In an embodiment, the frame holder 140-150 is of the rotating collectibles display 100 is adapted to hold a plurality of item frames (not shown). In an embodiment, the frame holder 140 comprises a frame holder top 141 connected to a frame holder base 144 by a plurality of frame holder support posts 147. Optionally, the frame holder can also comprise one or more frame holder handles 150.

In the illustrated embodiment, the frame holder top 141 is circular, and has a plurality of downward facing frame posts 142 disposed on the bottom of the top frame holder base about a frame holder top aperture 143. In other embodiments, the frame holder top could be any other suitable shape, for example, without limitation, a square, a hexagon, or an octagon.

In the illustrated embodiment, the frame holder base 144 is circular, and has a plurality of upward facing frame posts 142 disposed on the top of the top frame holder base about a frame holder base aperture 147. In other embodiments, the frame holder base could be any other suitable shape, for example, without limitation, a square, a hexagon, or an octagon.

In an embodiment, the frame holder top 141 in the frame holder base 144 are the same size and shape and the number of the upward facing hinge posts 145 is equal to the number of the downward facing hinge posts 142.

In an embodiment, the plurality of frame holder support posts 147 have a uniform a frame post length. In an embodiment, a bottom end of each of the plurality of frame holder support posts 147 is mounted at a respective position on the top side of the frame holder base 144, The respective position on the top side of the frame holder base is located between the frame holder base aperture 147 and a respective one of the plurality of upward facing frame hinge posts 145, wherein each of each of the frame holder support posts are mounted at a 90 degree angle to the top side of the frame holder base.

In an embodiment, the top end of each of the plurality of frame holder support posts 147 is mounted at a respective position 149 on the bottom side of the frame holder top 141. The respective position on the bottom side of the frame holder top is located between the frame holder top aperture 143 and a respective one of the plurality of downward facing frame hinge posts 142, wherein each of the each frame holder support posts are mounted at a 90 degree angle to the bottom side of the frame holder top, In an embodiment, the bottom and of each of the plurality of frame holder support posts 147 is mounted at a respective position 148 on the top side of the frame holder bottom 144. The respective position on the top side of the frame holder bottom is located between the frame holder bottom aperture 147 and a respective one of the plurality of downward facing frame hinge posts 145, wherein each of the each frame holder support posts are mounted at a 90 degree angle to the top side of the frame holder bottom, In an embodiment, the bottom of the frame holder top 141 and top of frame holder base 144 are mounted on the plurality of frame holder support posts 147 parallel to one another, such that each one of the downward facing hinge posts 142 faces a respective one of the upward facing hinge posts 145.

In an embodiment, the frame holder 140 is rotatably mounted on the stand such that the stand post 120 passes though the frame holder base aperture and the frame holder top aperture. In an embodiment, the bottom of the frame holder base 144 is seated on a ball bearing mechanism (not shown) on the stand holder base 110 that facilitates the rotation of the frame holder about the stand post 120. In other embodiments, other suitable mechanisms to be used to facilitate rotation of the frame holder 140 about the stand post 120.

In an embodiment, the top of the frame holder top 141 has one or more frame holder top handles 150 adapted to allow a user to rotate the frame holder 140 about the stand post 120. In the illustrated embodiment, there are two handles 150 mounted at a 90° angle to the top of the frame holder top 141. In various other embodiments there could be more or less handles, or no handles at all, and the handles could take any suitable form to be mounted on the frame holder top 141 at any suitable angle.

Figure 3:
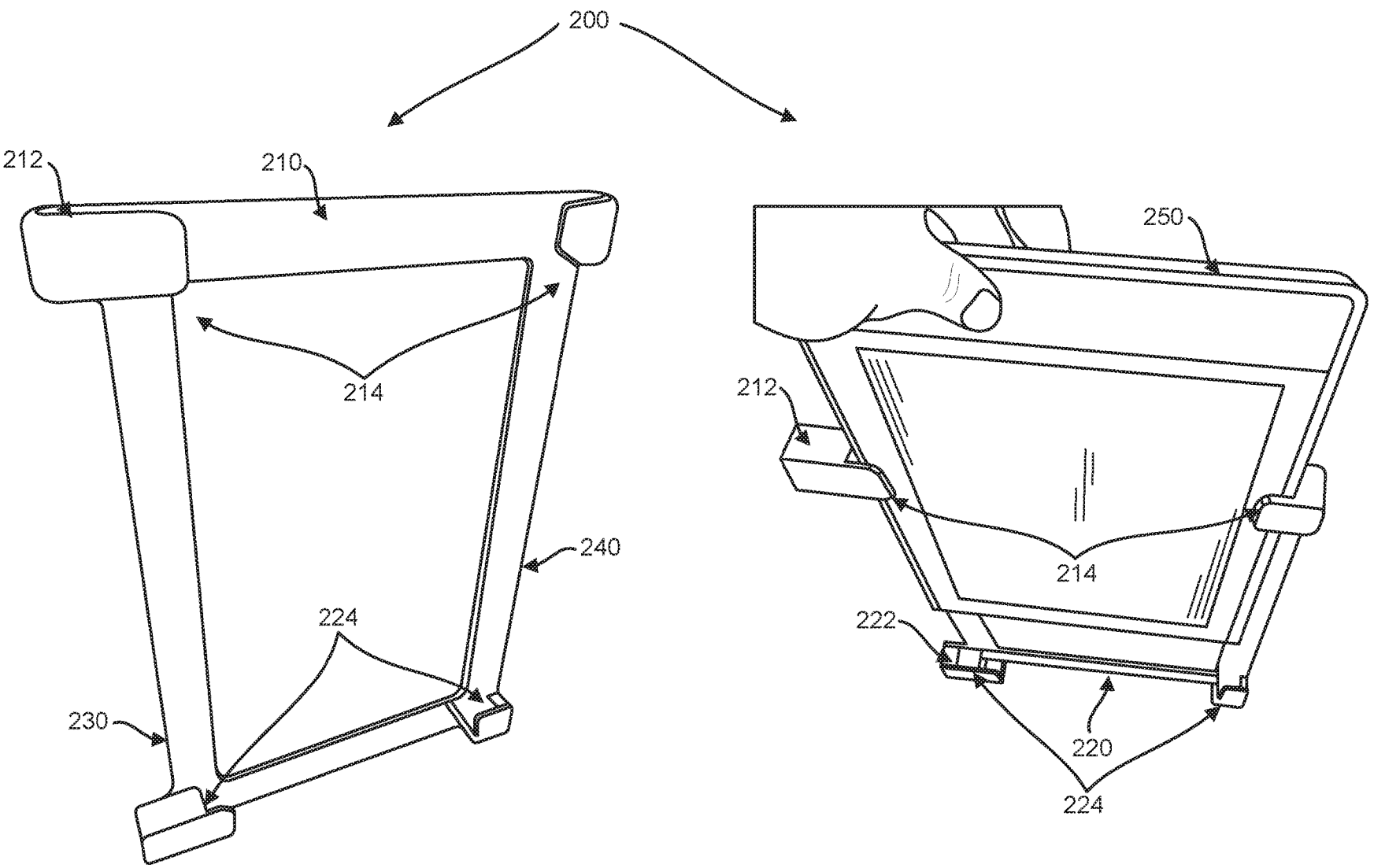
FIG. 3 shows two views of an exemplary item frame for comic books that can be mounted on the rotating collectibles display of FIG. 1 and FIG. 2.

FIG. 3 shows two views of an exemplary item frame 200 for comic books that can be mounted on the rotating collectibles display of FIG. 1 and FIG. 2. In an embodiment, the item frame 200 has an item frame top 210, and item frame bottom to 220, a first item frame side 230, and a second item frame side 240. In the illustrated embodiment, the components of the item frame 200 are joined together to form a square shaped frame, although other suitable shapes are also possible, such as a trapezoidal shaped frame.

In the illustrated embodiment, the top of the item frame 210 has an upward facing hinge insertion point adjacent to the first item frame side 230, and the item frame bottom 220 has a downward facing hinge insertion point 222 adjacent to the first item frame side 230.

In an embodiment, the item frame further comprising at least one item frame compartment 250 with a transparent front panel and a transparent back panel. The size of the item frame compartment is adapted to hold a type of collectible item. In the illustrated embodiment, the single item frame compartment is sized to hold a comic book or magazine. In the illustrated embodiment, the item frame compartment is a separate unit that can be held in the frame by brackets 214 on the top of the item frame 110, and by brackets 224 on the bottom of the frame 220.

In other embodiments, item frame compartments may be integral to the item frame, such as those embodiment shown in FIG. 5 (discussed further below).

Figure 4:
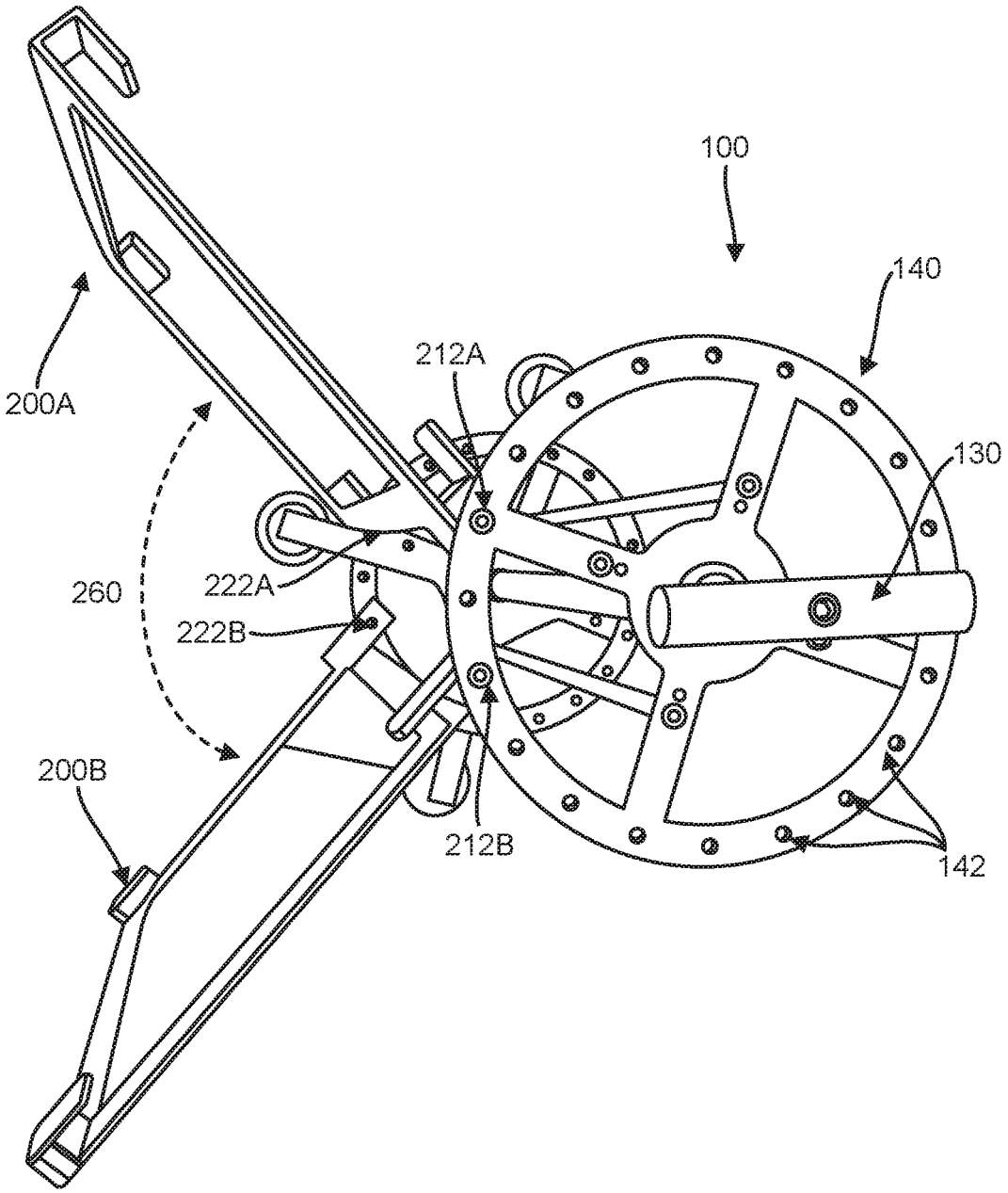
FIG. 4 shows the rotating collectibles display of FIG. 1 with two of the item frames of FIG. 3 mounted on the frame holder of the rotating collectibles display.

FIG. 4 shows the rotating collectibles display 100 of FIG. 1 with two of the item frames 200*a* and 200*b* of FIG. 3 mounted on the frame holder of the rotating collectibles display.

In an embodiment, each of the item frames 200*a*, and 200*b* is rotatably mounted on the item frame holder 140 such that a respective one of the plurality of downward facing hinge posts 142 is inserted into the respective upward facing hinge points 212*a* and 212*b* of the item frames 200*s* and 200*b*, and a respective one of the upward facing hinge posts (not visible) facing the respective downward facing hinge post 142 is inserted into the respective downward facing hinge points 222*a* and 222*b* of the item frames 200*a* and 200*b*.

As so mounted, each of the item frames 200*a* and can freely rotate 260 about its respective upward facing hinge point 212*a* and 212*b* and its respective downward facing hinge point 222*a* and 222*b* though a respective angle of at least 90 degrees, and potentially up to at least 180 degrees.

Figure 5:
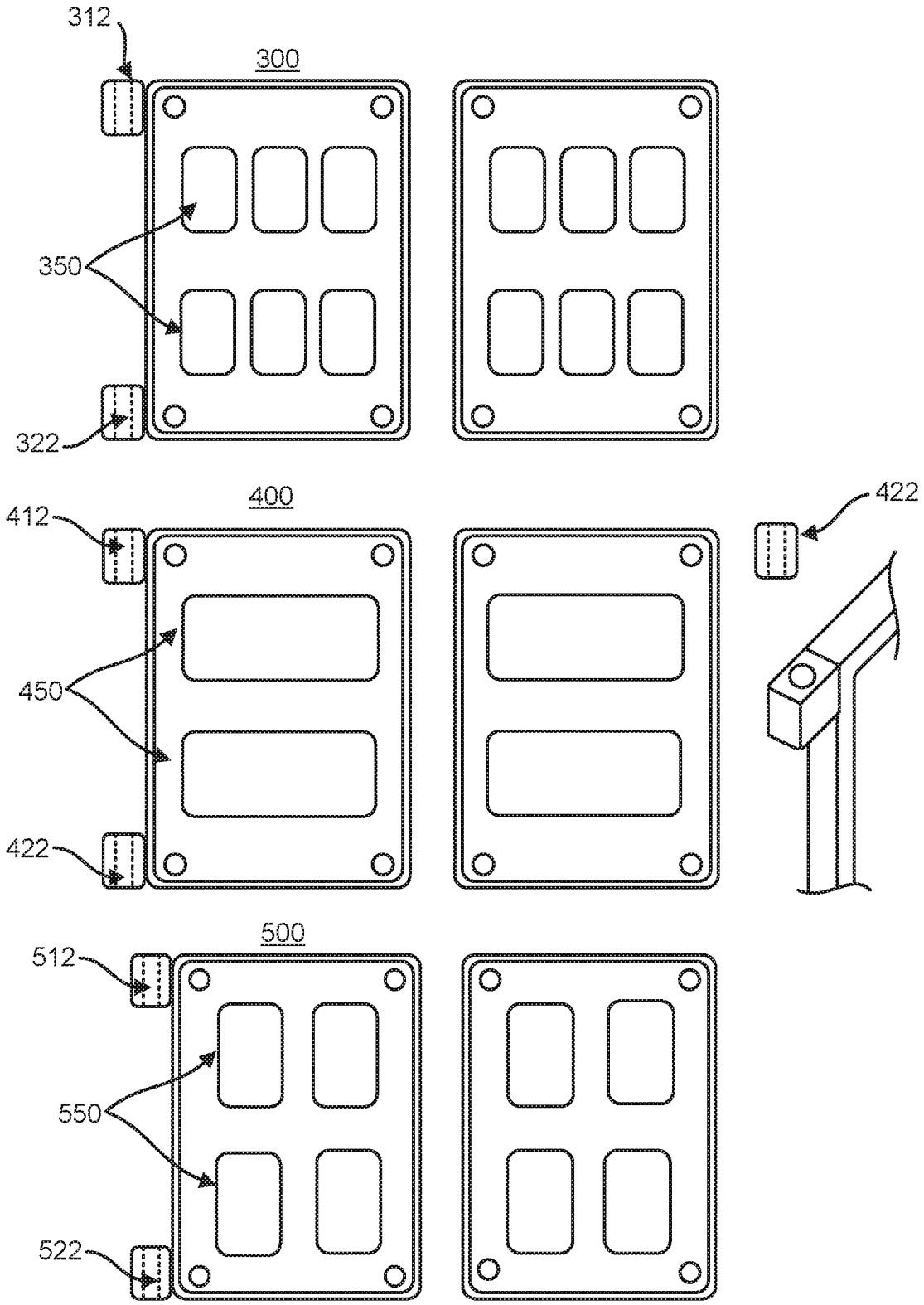
FIG. 5 shows other exemplary frame holders that can be mounted on the frame holder of the rotating collectibles display.

FIG. 5 shows other exemplary frame holders 300, 400, and 500 that can be mounted on embodiments of the frame holder of the rotating collectibles display of present disclosure, such as those shown in FIG. 1 to FIG. 4.

The item frame 300 has item compartments 350 sized to hold stamps or coins. The item frame 400 has item compartments 450 sized to hold to hold paper currency. The item frame 500 has item compartments 550 sized to hold to hold trading cards. Each of the item frames 300, 400, and 500, respectively, are configured to have downward facing hinge points 312, 412, and 512, and upward facing hinge points 322, 422, and 522. The respective item compartments 350, 450, and 550 can have either one, or two, transparent facings (e.g. front and back views), Other sizes are possible, as will be readily apparent to those skilled in the art, for example, a single item frame could have two or more different sized compartments, In various embodiments, the rotating collectibles display can be fabricated using any suitable materials. For example, the stand base, holder, and handle, as well as the frame holder, can be fabricated from metal and the item frames can be fabricated from plastic, for example via a molding process, or by a 3D printer. Numerous other variations will be readily apparent to those skilled in the art and are within the intent of this disclosure.

In the foregoing specification, the disclosure has been described with reference to specific exemplary embodiments of it. It will be evident that various modifications may be made thereto without departing from the broader spirit and scope as set forth in the following claims. The specification and drawings are, accordingly, to be regarded in an illustrative sense rather than a restrictive sense.

The invention claimed is:

1. A rotating collectible display, comprising:

a stand, the stand comprising:

a stand base, and a stand post attached to a top of the stand base;

a frame holder comprising:

a frame holder base comprising an aperture, the frame holder base further having a plurality of upward facing frame hinge posts disposed on a top side of the frame holder base around the aperture of the frame holder base, a frame holder top comprising an aperture, the frame holder top further having a plurality of downward facing frame hinge posts disposed on a bottom side of the frame holder top about the aperture of the frame holder top, and a plurality of frame holder support posts fixedly connecting the frame holder top to the frame holder base, wherein a bottom end of each frame holder support post is fixedly mounted at a respective position on the top side of the frame holder base, and wherein a top end of each frame holder support post is fixedly mounted at a respective position on the bottom side of the frame holder top, wherein the frame holder is rotatably mounted on the stand such that the stand post passes though the aperture of the frame holder base and the aperture of the frame holder top; and a plurality of item frames, wherein each item frame comprises a respective item frame top, a respective item frame bottom, a respective first item frame side and a respective second item frame side, the respective item frame top having a respective upward facing hinge insertion point adjacent to the respective first item frame side, and the respective item frame bottom having a downward facing hinge insertion point adjacent to the respective first item frame side; wherein each item frame is rotatably mounted on the frame holder such that a respective one of the plurality of downward facing frame hinge posts is inserted into the respective upward facing hinge insertion point of said each item frame and a respective one of the upward facing frame hinge posts facing the respective downward facing frame hinge post is inserted into the respective downward facing hinge insertion point of said each item frame, and further such that said each item frame enables one or more items to be inserted into said each item frame without removing said each item frame from the frame holder.

2. The rotating collectible display of claim 1, wherein each item frame can freely rotate about its respective upward facing hinge insertion point and its respective downward facing hinge insertion point through a respective angle of at least 90 degrees.

3. The rotating collectible display of claim 2, wherein the respective angle is at least 120 degrees.

4. The rotating collectible display of claim 2, wherein the respective angle is at least 160 degrees.

5. The rotating collectible display of claim 2, wherein the respective angle is at least 180 degrees.

6. The rotating collectible display of claim 1, wherein the frame holder base and the frame holder top are the same size and shape and a number of the upward facing frame hinge posts is equal to a number of the downward facing frame hinge posts.

7. The rotating collectible display of claim 6, wherein the respective position on the top side of the frame holder base is located between the aperture of the frame holder base and a respective one of the plurality of upward facing frame hinge posts, and the respective position on the bottom side of the frame holder top is located between the aperture of the frame holder top and a respective one of the plurality of downward facing frame hinge posts.

8. The rotating collectible display of claim 7, wherein the bottom side of the frame holder top and the top side of the frame holder base are mounted on the plurality of frame holder support posts parallel to one another, such that each one of the downward facing frame hinge posts faces a respective one of the upward facing frame hinge posts.

9. The rotating collectible display of claim 1, wherein the bottom side of the frame holder base is seated on a ball bearing mechanism on the top of the stand base that facilitates the rotation of the frame holder about the stand post.

10. The rotating collectible display of claim 1, wherein a top side of the frame holder top has at least one frame holder top handle adapted to allow a user to rotate the frame holder about the stand post.

11. The rotating collectible display of claim 1, additionally comprising a stand handle mounted to a top end of the stand post.

12. The rotating collectible display of claim 1, wherein each item frame of the plurality of item frames further comprises at least one item frame compartment.

13. The rotating collectible display of claim 12, wherein the at least one item frame compartment comprises a respective transparent front panel and a respective transparent back panel.

14. The rotating collectible display of claim 12, wherein a size of the at least one item frame compartment is adapted to hold a type of collectible item.

15. The rotating collectible display of claim 14, wherein the type of collectible item is one of comic books, magazines, stamps, coins, paper currency and trading cards.

16. The rotating collectible display of claim 14, wherein there are at least two item frame compartments in one of the plurality of item frames, the at least two item frame compartments comprising at least one item frame adapted to hold a first type of collectible item, and at least one item frame adapted to hold a second type of collectible item.

17. The rotating collectible display of claim 1, wherein the stand and the frame holder are constructed of metal.

18. The rotating collectible display of claim 17, wherein the plurality of item frames are constructed of plastic.

19. The rotating collectible display of claim 17, wherein the stand, the frame holder, and the plurality of item frames are constructed of at least one of metal, plastic, rubber, and wood.

20. A rotating collectible display, comprising:

a stand, the stand comprising:

a stand base, and a stand post attached to a top of the stand base;

a frame holder adapted to hold a plurality of frames, the frame holder comprising:

a frame holder base comprising an aperture, the frame holder base further having a plurality of upward facing frame hinge posts disposed on a top side of the frame holder base around the aperture of the frame holder base, a frame holder top comprising an aperture, the frame holder top further having a plurality of downward facing frame hinge posts disposed on a bottom side of the frame holder top about the aperture of the frame holder top, and a plurality of frame holder support posts fixedly connecting the frame holder top to the frame holder base, wherein a bottom end of each frame holder support post is fixedly mounted at a respective position on the top side of the frame holder base, and wherein a top end of each frame holder support post is fixedly mounted at a respective position on the bottom side of the frame holder top, wherein the frame holder is rotatably mounted on the stand such that the stand post passes though the aperture of the frame holder base and the aperture of the frame holder top;

a plurality of compartments configured to hold at least one item;

a plurality of item frames, wherein each item frame comprises a respective item frame top, a respective item frame bottom, a respective first item frame side and a respective second item frame side, the respective item frame top having a respective upward facing hinge insertion point adjacent to the respective first item frame side, and the respective item frame bottom having a downward facing hinge insertion point adjacent to the respective first item frame side, and wherein each item frame further comprises a set of brackets configured to hold at least one compartment of the plurality of compartments; wherein each item frame is rotatably mounted on the frame holder such that a respective one of the plurality of downward facing frame hinge posts is inserted into the respective upward facing hinge insertion point of said each item frame and a respective one of the upward facing frame hinge posts facing the respective downward facing frame hinge post is inserted into the respective downward facing hinge insertion point of said each item frame, and further such that the set of brackets of said each item frame enable said at least one compartment of the plurality of compartments to be inserted into said each item frame without removing said each item frame from the frame holder.

* * * * *